US005383339A

United States Patent [19]

McCloskey et al.

[11] Patent Number: 5,383,339

[45] Date of Patent: Jan. 24, 1995

[54] SUPPLEMENTAL COOLING SYSTEM FOR COUPLING TO REFRIGERANT-COOLED APPARATUS

[75] Inventors: William D. McCloskey, Baltimore, Md.; Thomas W. Brady, Westchester, Ill.

[73] Assignee: Baltimore Aircoil Company, Inc., Jessup, Md.

[21] Appl. No.: 988,656

[22] Filed: Dec. 10, 1992

[51] Int. Cl.[6] ..... F25D 3/00

[52] U.S. Cl. ..... 62/238.5; 62/434

[58] Field of Search ..... 62/59, 79, 201, 238.1, 62/238.5, 238.6, 430, 434

[56] References Cited

U.S. PATENT DOCUMENTS

| | | | |
|---|---|---|---|
| 1,523,112 | 1/1925 | Fitzgerald . | |
| 1,782,651 | 11/1930 | Hoffman . | |
| 2,120,185 | 6/1938 | Philipp | 62/2 |
| 2,460,623 | 2/1949 | Zoppola | 62/134 |
| 2,712,732 | 7/1955 | McGrew | 62/4 |
| 3,299,651 | 1/1967 | McGrath | 62/238.5 |
| 3,675,441 | 7/1972 | Perez | 62/278 |
| 4,409,796 | 10/1983 | Fisher | 62/160 |
| 4,476,690 | 10/1984 | Iannelli | 62/198 |
| 4,493,193 | 1/1985 | Fisher | 62/160 |
| 4,553,401 | 11/1985 | Fisher | 62/160 |
| 4,570,449 | 2/1986 | Knokey et al. | 62/183 |
| 4,608,836 | 9/1986 | MacCracken et al. | 62/325 |
| 4,637,219 | 1/1987 | Grose | 62/199 |
| 4,693,089 | 9/1987 | Bourne et al. | 62/79 |
| 4,720,984 | 1/1988 | Ames | 62/434 |
| 4,964,279 | 10/1990 | Osborne | 62/59 |
| 4,966,007 | 10/1990 | Osborne | 62/101 |
| 5,038,574 | 8/1991 | Osborne | 62/101 |
| 5,150,581 | 9/1992 | Smith | 62/115 |

FOREIGN PATENT DOCUMENTS

| | | | |
|---|---|---|---|
| 2620133 | 11/1977 | Germany | 62/430 |

OTHER PUBLICATIONS

Brochure-"Supermarket Air Conditioning and Dehumidification"-Electric Power Research Institute.

"Two-Stage System Uses R-22"-Gordon Duffy and Ed Bas: from Air Conditioning, Heating & Refrigeration News; Aug. 17, 1992.

*Primary Examiner*—Henry A. Bennet
*Assistant Examiner*—Willian C. Doerrler
*Attorney, Agent, or Firm*—Edward J. Brosius; F. S. Gregorczyk; Thomas J. Schab

[57] ABSTRACT

A supplemental cooling system couplable to at least one refrigerant-cooled apparatus with a refrigerant circuit to reduce the refrigerant temperature in the refrigerant circuit, which cooling system is shown with a thermal storage system as well as an auxiliary condensing arrangement for coupling the refrigerant circuit and supplemental cooling system.

28 Claims, 2 Drawing Sheets

SUPPLEMENTAL COOLING SYSTEM FOR COUPLING TO REFRIGERANT-COOLED APPARATUS

BACKGROUND OF THE INVENTION

The present invention relates to a system for air-conditioning and refrigeration. More specifically, the system provides a method and apparatus for coupling an ice-storage system to existing cooling and refrigeration devices to enhance their performance, efficiency and reduce the overall power consumption, or the cost to achieve the same operating result by reducing the power demand at peak operating periods.

An illustration and explanation of the need for expansion of the range of existing cooling devices, reduction of the operating expense or both conditions is provided in a brochure from the Electric Power Research Institute, "Supermarket Air Conditioning and Dehumidification". Although the modern convenience of the grocery store or supermarket with its air conditioned aisles, glassed or open-front freezers and display cases, and its cold-storage lockers is accepted by consumers, the costs to install, run or maintain these large cooling apparatus are not considered. Several alternative systems for supermarket cooling requirements are illustrated and discussed in the noted brochure, which includes notations on the capital and operating costs as well as a discussion of the relative advantages and disadvantages of the several systems. In this brochure, which appears to have been published in 1990, the utilization of an ice-storage or cool storage system is briefly discussed, however, there is no illustration or detailed description of an operating system and only a recognition of the potential benefits that would accrue from such a system.

Conventional cooling apparatus generally consist of stand alone devices, such as air-conditioners and individual refrigeration assemblies, each having its own ductwork for air transfer, cooling circuit and power connections. The coupling of an ice-storage apparatus to an existing cooling unit can reduce its period of operation to attain the same cooling capacity, thus reducing its energy consumption during a peak electrical cost period; or alternatively, it can be viewed that the operating range of the unit is expanded, which results in a "larger cooling capacity" unit without replacement. Further, multiple cooling devices can be connected to this ice-storage system for simultaneous operation. Illustrative of a facility with multiple cooling devices is the grocery store or supermarket, which commercial facility will frequently have an air-conditioning apparatus, a freezer or cooler with a door for goods such as ice-cream, an open cooler for dairy products and frozen juices, and a sub-zero cooler for storage of other foodstuffs. In a new installation, the size and configuration of some or all of the ancillary devices coupled to the ice-storage system can be reduced in size or rated capacity to deliver the same cooling capacity, which can result in an initial capital cost reduction.

Further benefits result in the ability to expand the usage of the ice-storage system to other parasitic apparatus; production of ice in the off-peak periods of electric usage, generally nighttime, reduces the cost of power to produce the requisite cooling; and, only nominal capital cost is incurred with this known basic technology.

SUMMARY OF THE INVENTION

A system to incorporate an ice-storage system with existing cooling and refrigeration devices without elaborate usage of control valves, sensors and other control components is provided for usage with any of air-conditioning, refrigeration or humidification/dehumidification devices. In its basic form, the ice-storage apparatus incorporates a compressor; an air-cooled, water-cooled or evaporative condenser; an ice-storage tank with a cooling coil therein; and, a fluid circulating circuit with a circulating pump, as well as conduit and expansion valves commonly associated with an ice-storage system. The compressor or compressors are operable to receive cool low-pressure refrigerant gas and compress it to a hot high-pressure gas for communication to a condenser to condense the vapor to a liquid and to dissipate the heat to the atmosphere. The high-pressure liquid is communicated to the ice-storage tank, which is filled with a fluid for freezing such as water or a water/glycol mixture. The spent refrigerant is returned to the compressors for recirculation through the circuit. During operation of the compressor(s) and condenser, ice is formed in the ice-storage tank, however, not all of the fluid may be frozen, and the compressor-freezing cycle is not continuous but is run only until the ice is formed. A parasitic or coupled cooling device is connected to the fluid in the storage tank, which fluid is utilized to reduce the coupled-device refrigerant temperature and to enhance the operating efficiency of such coupled device, especially during peak periods of cooling demand, such as the middle of the day in hot, humid weather. The circulating pump circulates fluid from the ice-storage tank, which is approximately at the freezing temperature of the water or coolant mixture, to the coupling component of the parasitic cooling device, which component provides heat transfer to the refrigerant of the coupled device.

In an exemplary application, where the coupled device is a low-temperature condensing application having an independent refrigerant circuit similar to the ice-storage refrigeration circuit, an auxiliary condenser can be provided for coupling to both the compressor discharge conduit and the ice-storage fluid circuit. Heat transfer between the coupled-device refrigerant and the low-temperature coolant fluid is provided in the auxiliary condenser, which provides liquid refrigerant at a temperature very much below the temperature of the liquid refrigerant from the air-cooled or evaporative condenser for transfer of a colder refrigerant liquid with little or no added power input or work from the compressor-condenser circuit of the coupled device. The cooler liquid refrigerant entering the evaporator requires less work from a compressor, the same or less work as an air cooled condenser, reduces the application device operating pressure and power consumption from the compressor, or requires less device operating time. The ice-storage fluid is returned to the ice-storage tank from the condenser. However, the low-temperature refrigerant is operable to provide the necessary temperature drop in the application, and in a supermarket this may be a refrigerated display case or low-temperature (e.g., −10 F. to −40 F.) storage freezer.

Alternatively, the fluid circuit may also be connected to a coupling device for a sub-cooling application where fluid from the air-cooled or evaporative condenser is communicated to a liquid refrigerant subcooler for transfer to a subcooling application. The evaporating temperature of a sub-cooling application may, for example but not as a limitation, be about in the range of 0 F. to about 25 F., and the required amount of fluid from the ice-storage fluid circuit may not be as great as in the above-noted low-temperature condensing application. However, the fundamental concept is to utilize the low-temperature fluid produced at the off-peak power cost period, to reduce demands on the refrigerant circuit of the coupled device by use of the low-temperature fluid, thereby providing operating efficiencies not otherwise available. Either of these first two applications may be used in existing supermarkets to offset the capacity loss of the compressors when a chloro fluoro carbon (CFC) refrigerant is replaced by a non-CFC refrigerant.

In another exemplary case, the coolant fluid from the ice-storage fluid circuit may be diverted to an air-cooling application to provide a measure of direct heat transfer and minimize the demands on the existing equipment, such as the display area air handling unit, which may have to accommodate a dehumidification condition. Dehumidification may be accommodated by low-temperature air conditioning devices, however, this often results in the icing of the cooling coils and reduction of efficiency of the cooling apparatus. Therefore, air cooling without icing of the compressor-coupled coils would maintain their rated operating efficiency and thereby increase the overall operating efficiency of the unit without excess added cost. This is especially true in units where the air-cooling application is an added cooling device and not the primary device utilizing the ice-storage tank fluid. In the above-noted supermarket illustration, the in-store relative humidity is more easily maintained by achieving better control of the cooling coil temperature.

BRIEF DESCRIPTION OF THE DRAWINGS

In the Figures of the drawings, like reference numerals identify like components, and in the drawings.

DETAILED DESCRIPTION OF THE PREFERRED EMBODIMENT OF THE INVENTION

An independent cooling system in accordance with the present invention is operable to provide reduced-temperature cooling to a primary cooling apparatus and adaptable to connect multiple parasitic units for reduction of their refrigerant coolant temperatures to improve their operating efficiency, expand the operating range and/or reduce their operating cost.

Figure 1:
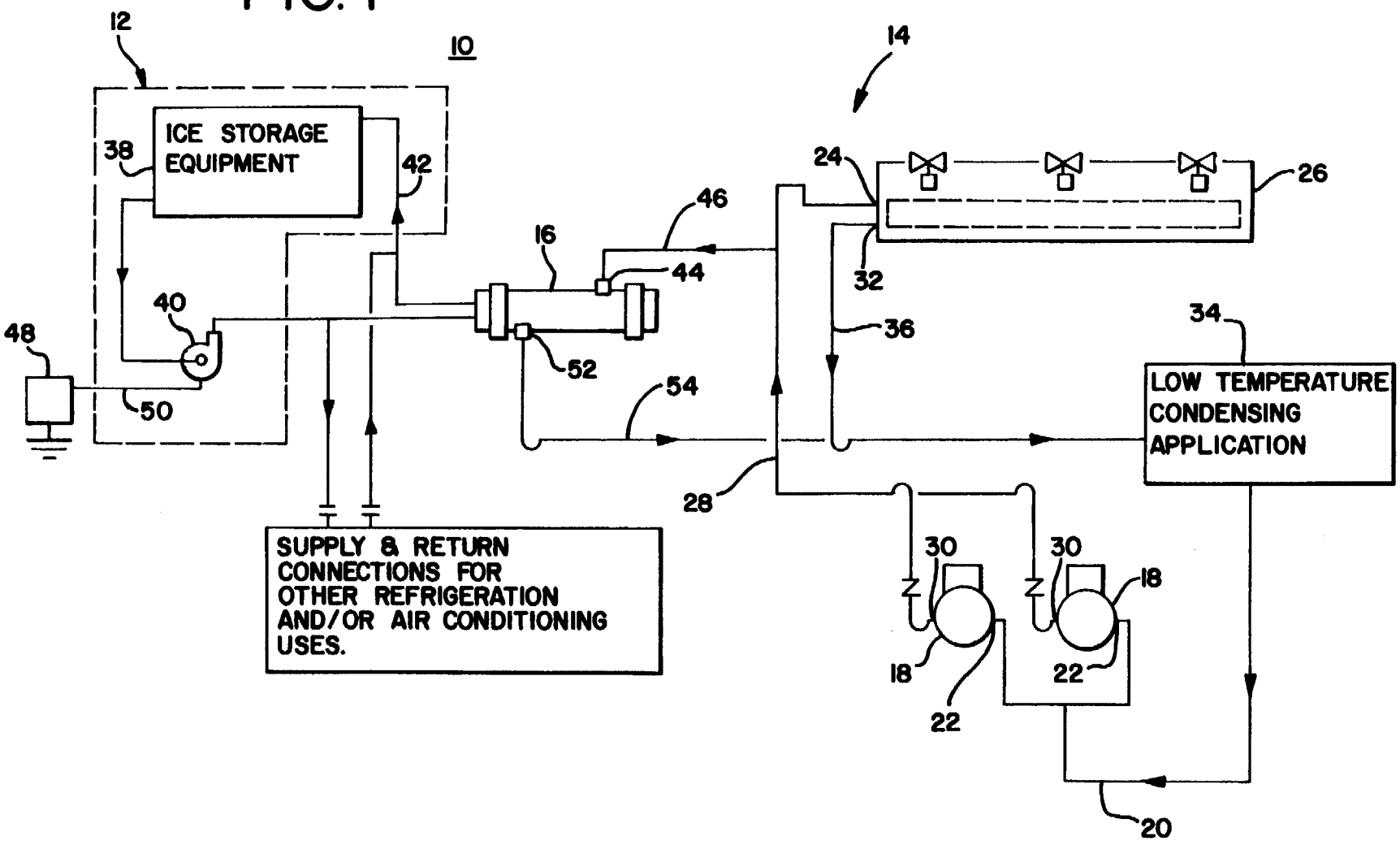
FIG. 1 is a diagrammatic view of the preferred embodiment of the invention with a single coolant apparatus coupled to the ice-storage fluid circuit; and, FIG. 2 is a diagrammatic view of an exemplary view of an embodiment for a supermarket application.

Cooling system 10 in FIG. 1 provides a supplemental cooling circuit 12, which is independently operable from a primary cooling or refrigeration apparatus or circuit 14, but operably coupled to the circuit through a coupling apparatus, shown as an auxiliary condenser 16. In this exemplary illustration, refrigeration apparatus 14 is a low-temperature evaporating application such as a display or storage cooler in a supermarket. This form of an application is considered a low-temperature application, as it is operable in a temperature range of about −10 to −40 degrees F. In the same vein, a moderate temperature application will be about in the 0 to 25 degree F. range, and a high-temperature application will be above about 32 degrees F. There are some obvious gaps in the temperature ranges, but the ranges are merely illustrations, not limitations.

Refrigeration apparatus 14 has at least one compressor 18 and, as shown in FIG. 1, may have a plurality of compressors 18 arranged in parallel to provide compression of a low-pressure gas. The low-pressure refrigerant vapor is transferred by conduit 20 to input ports 22 of each of compressors 18 for compression to a warm high-pressure vapor. The terms high and low-pressure refer to the difference in the pressures across the operating devices, such as the compressors, not to the absolute pressures of the fluids and vapors. The warm, high-pressure refrigerant vapor is communicated to entry passage 24 of air-cooled or evaporative condenser 26 through conduit 28 from discharge ports 30 of compressors 18. The warm refrigerant vapor is cooled and condensed in condenser 26 to provide a refrigerant liquid at output passage 32, which fluid is communicated to display or storage area 34 through conduit 36, to cool area 34 to a desired temperature. Condenser 26 is operable in a standard manner to condense the vapor to a fluid and discharge the evolved heat to the atmosphere. Refrigeration apparatus 14 is thus seen to be a conventional installation of a cooling device or cooling circuit for a specific application.

Supplemental cooling circuit 12 in FIG. 1 is an ice-storage assembly. More specifically, circuit 12 has ice-storage equipment 38, such as taught and illustrated in U.S. Pat. No. 4,964,279 to Osborne, which utilizes a compressor, condenser and an ice-storage facility with a cooling coil to freeze a cooling fluid in the tank. The frozen mass, which may include both solid and liquid, provides reduced temperature material for coupling to an ancillary cooling circuit to assist in the cooling function.

Circuit 12 in FIG. 1 has coolant pump 40 coupled between ice-storage equipment 38 and condenser 16 to pump reduced temperature fluid, such as ice-water, to condenser 16 from equipment 38. Condenser 16 is the exemplary coupling apparatus between refrigeration device 14 and cooling circuit 12. Fluid return conduit 42 between condenser 16 and equipment 38 communicates spent cooling fluid from condenser 16 to equipment 38 for recycling therein.

In FIG. 1, auxiliary condenser 16, which may be a counterflow tube heat exchange device or other known apparatus, is coupled at its input port 44 by connecting line 46 to conduit 28 for transfer of high-pressure vapor to condenser 16. A temperature drop from ambient temperature in condenser 16, which is induced by coolant fluid from ice-storage equipment 38 being pumped by pump 40 to condenser 16 in response to an external signal from a sensing and signal device 48. This sensing and signal device 48 is coupled to pump 40 by line 50 and may be any one of known sensing and signal device, for example, a humidstat, a thermostat or a timer, to activate pump 40 for transfer of the reduced-temperature fluid from equipment 38 to condenser 16. Discharge port 52 of condenser 16 is coupled to liquid refrigerant line 36 by line 54 to communicate refrigerant fluid from auxiliary condenser 16 to line 36, which refrigerant from auxiliary condenser 16 is chilled by ice-storage fluid to a temperature less than liquid refrigerant from primary condenser 26. This increased temperature drop in the refrigerant of apparatus 34 expands the operating range of an existing cooling circuit 14. The decreased refrigerant temperature will induce an increased temperature drop in apparatus 34 without adding either increased compressor loading or added capacity to condenser 26 to achieve a required temperature drop at apparatus 34. Further, the coupling network associated with auxiliary condenser 16, the coupling device, does not require a plurality of control valves and sensors, as the fluid flow through lines 46 and 54 is actuated by the differential temperature of fluid flow from pump 40. The drop-leg arrangement is known in the art and is utilized in system 10 to obviate the usage of unnecessary control valves. Condenser 26 does not have to be deactuated when condenser 16 is activated as operation of condenser 16 and the "drop-leg" effect effectively stops the flow of refrigerant to condenser 26. However, the fans usually associated with condensers should be turned off to conserve energy.

In the above-noted supermarket application, the expanded operating-temperature range provides added cooling capacity and reduces operating power consumption to the primary cooling circuit 14 without increasing the capacity or number of compressors 18. This latter advantage provides the necessary operating capacity for the circuit 14 under extreme temperature and humidity conditions, such as hot, humid summer conditions in sunbelt environments. In FIG. 1, supplemental cooling circuit 12 is coupled to a single cooling circuit, but it is couplable to a plurality of ancillary cooling circuits to simultaneously provide increased cooling capacity to these several alternative units.

Figure 2:
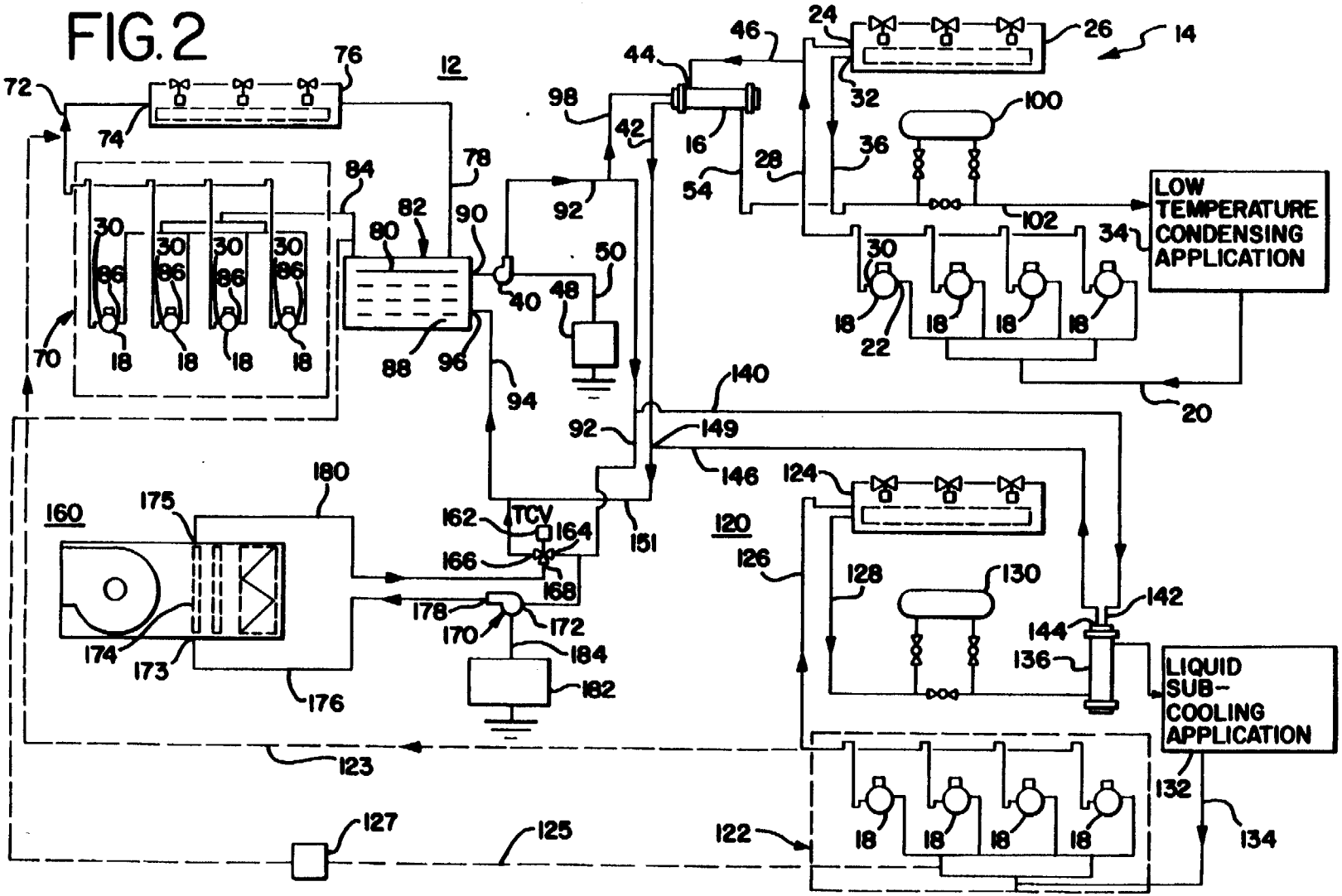

In an illustrative and detailed embodiment of the present invention shown in FIG. 2, supplemental cooling circuit 12 has a compressor rack or assembly 70, which has a plurality of compressors, such as compressors 18, arranged in a parallel alignment and operable to receive a refrigerant vapor at a relatively low pressure for compression to a higher presssure and discharge through a discharge port 30 at the second and higher pressure to a conduit 72. Conduit 72 is coupled between discharge port or ports 30 and inlet passage 74 of condenser 76, which is operable to condense the high-pressure vapor to a liquid for transfer through output passage 78 and coil 80 in ice-storage tank 82. Coil 80 is coupled to compressor rack 70 by conduit 84 to return the spent coolant fluid as warm, low-pressure vapor to the input ports 86 of the compressors 18 of rack 70. Chamber 88 of tank 82 has a fluid, such as water or a water/glycol mixture, which may be frozen on coils 80, either completely or partially. Generally the partially frozen fluid in tank 82 is approximately at its freezing temperature, but still a liquid for pumping, that is at least some of the liquid has not experienced a change of state and may be pumped as a liquid. In this figure, circulating pump 40 is coupled to an outlet opening 90 of tank 82 and has a downstream conduit 92 for transfer of the cold liquid from chamber 88. Return conduit 94 extends from return-fluid opening 96 and is coupled in a closed loop arrangement for return of all spent or warmed liquid to tank chamber 88.

The low-temperature evaporating application described for circuit 14, and more specifically auxiliary condenser 16, is coupled to downstream conduit 92 by conduit 98 for communication of the cooled liquid from chamber 88 at activation of pump 40 by signal device 48. In addition, fluid circuit 14 has a liquid receiver 100 in parallel with liquid refrigerant conduit 102, which is connected to both conduits 54 and 36 to communicate liquid refrigerant to evaporator apparatus 34. Liquid receiver 100 is only provided as a reservoir apparatus for liquid refrigerant. As noted in this figure, discharge conduit 42 is connected to return conduit 94 for recycling of spent cooling fluid from condenser 16.

Alternative cooling apparatus 120, such as a sub-cooling application for an intermediate or moderate temperature cooling application in the above-noted supermarket environment, again utilizes a compressor rack or assembly 122, which may have a plurality of compressors 18, an air-cooled or evaporative condenser 124, compressed vapor line 126, condensed liquid line 128, liquid receiver 130 in parallel with line 128, and application device or apparatus 132, which may be an evaporator or multiple evaporators. Refrigerant return line 134 from apparatus 132 is coupled to compressor rack 122 for recycling of the warm, low-pressure refrigeration vapor from apparatus 132. A liquid sub-cooler 136 is the coupling apparatus in fluid circuit 120 and is coupled in line 128 between apparatus 132 and condenser 124 for communication of the liquid refrigerant therethrough. Sub-cooler 136 is also coupled to downstream conduit 92 in parallel with apparatus circuit 14 to receive low-temperature fluid from chamber 88 to cool refrigerant below the exiting-liquid temperature from condenser 124. Conduit 140 connects downstream conduit 92 with sub-cooler inlet port 142 and, sub-cooler outlet port 144 is connected to return conduit 94 by line 146, which in the figure is joined with discharge line 42 at junction 149 to form conduit 151. Sub-cooler 136 may operate similarly to auxiliary condenser 16 to reduce the temperature of refrigerant passing through sub-cooler 136 to apparatus 132. The coolant fluid from tank chamber 88 may only be communicated to sub-cooler 136 at actuation of pump 40, however, the rate of fluid flow through sub-cooler 136 may be a function of the size of conduit 140, an orifice valve or other control parameter, if required by the specific application.

Air-cooling application or apparatus 160, such as an air handling unit for a display area, is illustrated as coupled to downstream conduit 92 to provide communication of coolant fluid from tank chamber 88 to apparatus 160. Control valve 162 is coupled between downstream conduit 92 at first port 164, and to return conduit 94 at second port 166. In a reference operating mode, fluid from conduit 92 passes through valve 162 for communication to return conduit 94. Circulating pump 170 is coupled between conduit 92 at its input passage 172 upstream of first port 164, and at its output passage 178 by conduit 176 to entry 173 of heat exchange device 174 in apparatus 160. Conduit 180 couples exit 175 with third port 168 of valve 162. Signal and/or sensing device 182 is coupled to pump 170 by line 184, and is operable to actuate fluid pump 170 to initiate flow to apparatus 160. In operation, coolant fluid flowing through conduit 92 and valve 162 to conduit 94 during actuation of first pump 40 may be electably communicated to apparatus 160 by actuation of circulating pump 170. Coolant fluid is diverted to apparatus 160 through heat exchanger 174 and third port 168 for transfer to return conduit 94. In this alternative mode, first port 164 is closed to divert fluid flow through pump 170 and valve 162 is controllable to maintain a desired temperature and relative humidity in an operating area.

The utilization of system 12 and the advantages associated therewith are exemplified by the illustration of FIG. 2. The potential advantages of coupling an ice-storage system with conventional air-cooling and refrigeration apparatus were noted in the above-cited EPRI brochure, however, the specific structure and arrangement of the components, as well as the coupling apparatus and their interactions have not previously been disclosed without multiple control valves, which control-valve circuit is disclosed and illustrated in U.S. Pat. No. 4,637,219 to Grose. Further, the coupling of multiple cooling and refrigeration apparatus to a single ice-storage assembly to draw on its cooling mass with a relatively simple piping network has not been previously disclosed or known generally and especially for a supermarket application. In operation, the system of FIG. 2 displays an outward appearance of a complex network, however, it is to be noted that low-temperature condensing application 14, liquid sub-cooling application 120 and air-cooling application 160 along with their associated components are extant structures in the supermarket environment, which structures are available on twenty-four hour duty in many facilities. Coupling of the ice-storage apparatus and the associated coupling devices require only nominal space, minimal capital outlay and a major potential reduction of power costs, as evidenced by the reallocation of available resources to lower cost operations. Further reductions in operating costs are available by adaptating ice-storage system 12 to existing cooling systems, which expands their operating range by retrofit rather than replacement with larger, more-expensive-to-operate structures to produce the same cooling or refrigeration capacity.

In operation, the illustrative system noted in FIG. 2 couples an ice-storage assembly 12 to coupling or control devices 16, 136 to provide on-demand cooling capacity beyond rated equipment capacities at "design" conditions or to reduce power demands during peak-cost periods for power. Assembly 12 is operable to provide a mass of frozen fluid, such as water or a water/glycol mixture, in storage tank 88. In the illustrated assembly 12, compressors 18 of rack 70 compress a low-pressure vapor refrigerant from conduit 84 to a high-pressure vapor refrigerant discharged to conduit 72 and condenser 76, which condenses the high-pressure vapor to a fluid for transfer to cooling coils 80 in tank chamber 88. This cooling circuit may incorporate thermal expansion valves or other standard equipment not specifically illustrated but known in the art. The refrigerant fluid in coils 88 cools and can freeze at least some of the coolant fluid to provide a liquid-solid fluid mass in tank 82, preferably at periods when the power costs are at a minimum, which in the hot, humid summer months, is usually the night time hours. This utilization of the off-peak power demand reduces operating costs as the frozen fluid is retained in an insulated tank 82 for later use. After the fluid is frozen, or after a period of operation, or other operational criteria, the compressors of rack 70 are deactivated and the system is on a standby mode. At peak coolant demand periods, such as the middle of a hot, humid summer day, electric power costs may be at a maximum for kilowatt-hour rates and existing equipment may be unable to provide adequate cooling to meet the application demands, or the existing equipment may be required to operate at its rated or peak capacity, which places undue demands on the equipment and may increase the associated maintenance costs. The use of coolant fluid from tank 82 in the subcooling operation reduces the load on compressors 18, which would allow at least some of the compressors to be cycled to an inoperative mode and to allow the remaining compressors to operate at lower discharge pressures.

In FIG. 2, the chilled fluid in ice-storage tank 82 can be circulated to coupling devices 16 and 136 of applications 34 and 132, respectively, for interaction with the application refrigerants to reduce their operating temperatures below the temperature available with the standard operating modes. More specifically, pump 40 is activated to circulate coolant fluid from tank 82, which is at or about the freezing temperature of the frozen material therein, to coupling devices 16, 136. Simultaneously the refrigerants of the coupled applications flow through the coupling devices and their temperatures are significantly reduced to provide a much lower fluid temperature to the apparatus or area being cooled. In the noted application circuits, there are no added control valves, rather the ice-storage fluid is continuously circulated to the coupling devices 16 and 136. In the case of the low-temperature condensing application 34, coolant fluid communicated to condenser 16 causes the refrigerant gas to condense to a liquid in condenser 16, which liquid fills conduit 54. The static height of liquid in conduit 54 creates sufficient pressure to effectively stop refrigerant flow through conduit 36 from condenser 26, which induces reduced temperature refrigerant to be communicated from condenser 16 to conduit 102 and apparatus 34. The lower temperature refrigerant expands the temperature range of this low-temperature condensing application and can maintain the desired operating temperature on unseasonably warm days or conditions without causing excessive demands on the compressor-condenser refrigerant circuit, which reduces the power consumption of the circuit. Refrigerant flow through auxiliary condenser 16 may be ceased by discontinuing coolant fluid flow from tank 82. In circuit 14, coolant fluid is circulated through auxiliary condenser 16 and transferred to return conduits 42, 151 and 94. The rate of fluid flow, refrigerant flow, temperature drop and other operating parameters are dependent upon the dimensions of the several components and their operating capacities, as well as environmental conditions. Pump 40, which is coupled between tank 82 and the coolant fluid flow circuit is actuable by signal/sensing device 48 to initiate coolant flow to the several cooling application devices in response to an external parameter, such as time, temperature, humidity or other operating condition. This actuation signal may be manual initiation of pump 40, the specific actuation means is not a limitation to the invention.

In the liquid sub-cooling application with apparatus 132, coolant fluid is continuously provided to subcooler 136 during operation of pump 40. The coolant flow rate may be controlled through the use of an orifice valve, sized piping or other control devices, if desired. However, refrigerant flow from air-cooled or evaporative condenser 124 of the refrigerant circuit is continuously transferred through sub-cooler 136 under all operating conditions in this exemplary cooling-application structure. The degree of sub-cooling of the refrigerant may be controlled or be responsive to the flow rates of the refrigerant and coolant fluid, the ambient temperature, the relative temperatures of the two fluids or other operating and environmental parameters. The precise drop in refrigerant temperature may be controlled by existing control devices on the extant cooling circuit for apparatus 132. Spent coolant fluid is communicated from sub-cooler 136 to return conduits 146, 149, 151 and 94 for recycling in tank 82. This process effectively increases the operating capacity of the existing compressors 18 without added capital investment in more or larger compressors.

Coolant flow to air-cooling apparatus 160 is electable by actuation of circulating pump 170 to divert coolant fluid from conduit 92 ahead of control valve 162. In this application, coolant fluid is directed through apparatus 160 to reduce the temperature of the heat-transfer component. In the reference mode with pump 170 deactivated, the coolant fluid is directly routed from line 92 through valve 162 for return to conduit 94 and tank 82. Circulating pump 170 is actuable by signal/sensing means 182 to open fluid flow to apparatus 160 ahead of valve 162, and in this sense pump 172 is operable as a valve or control device to limit fluid flow to apparatus 160.

In an alternative embodiment in FIG. 2, dashed line 123 extends between conduit 126 of sub-cooling application 120 and conduit 72 connected to condenser 76 of ice-storage system 12. In this embodiment, it is contemplated that compressor rack 122 may be operable in a dual-mode operation, that is it may operate in its convential mode during normal operating periods with sub-cooling circuit 120 and in off-peak periods or during normally low-usage periods, such as night time, this compressor rack 122 could be utilized in conjunction with ice-storage circuit 12 to freeze the coolant fluid in tank 82. If a modulated or controlled degree of subcooling is desired a two-way control valve may be provided in conduit 146 and modulated generally toward a closed position as less subcooling is desired.

In the Figure, return line 125 provides recycling of refrigerant to compressor rack 122. Control assembly 127, which is shown in line 125 but may be positioned in line 123, is operable to divert refrigerant flow to ice-storage assembly 12. This dual mode application would provide further capital cost savings, minimize the space requirements and maximize equipment utilization. The variations of this alternate use are many and include the use of the compressors 18 from low-temperature condensing application 14 in a similar capacity, or utilizing this alternate connection as an emergency backup apparatus.

The above discussion has noted specific and preferred embodiments and applications of the invention, however, it is recognized that the physical size, either in terms of design cooling capacity or physical equipment parameters will be accommodated dependent upon the individual application. In the illustration of the supermarket cooling demands, these design considerations may include the store operating hours, relative size of the facility and other design factors. Each of the factors may be considered but are not a limitation to the present invention.

While only specific embodiments of the invention have been described and shown, it is apparent that various alterations and modifications can be made therein. It is, therefore, the intention in the appendend claims to cover all such modifications and alterations as may fall within the scope and spirit of the invention.

We claim:

1. A supplemental cooling system couplable to at least one assembly with a refrigerant-cooled apparatus having a first refrigerant circuit with a first refrigerant and an evaporator, said supplemental cooling system operable to receive said first refrigerant at a first temperature ahead of said apparatus and to reduce the refrigerant first temperature, said supplemental cooling system comprising:

means for providing a refrigerant to cool a fluid, said refrigerant-providing means being one of said first refrigerant circuit and a second refrigerant circuit;

means for thermal storage having a housing with an output port and a return port, a phase change material fluid in said housing, means for freezing said phase change material, which freezing means is positioned in said housing and connected to said refrigerant-providing means to freeze at least a portion of said phase change material fluid at a second temperature and to cool said remaining portion of said fluid material in said housing to approximately the second temperature of said frozen phase change material, which frozen phase change material temperature is less than said first refrigerant temperature in said first refrigerant circuit;

means for connecting;

means for coupling having a first fluid path and a second fluid path, which coupling means is operable as means for exchanging heat and is connected by said connecting means in one of a parallel and a series arrangement with said first refrigerant circuit and said thermal storage means, said coupling means operable to receive said first refrigerant at said first temperature from said refrigerant circuit, which first temperature is greater than said second temperature, in one of said first and second fluid paths for flow through said coupling means before communication and return of said first refrigerant to said first refrigerant circuit and said evaporator of said refrigerant-cooled apparatus;

means for pumping said phase change material connected between the other of said coupling means first and second fluid paths and said housing output port to communicate said phase-change fluid material from said housing to said other fluid path of said first and second fluid paths in said coupling means;

said connecting means connecting said other of said first and second fluid paths and said housing input port to return said phase change fluid to said housing from said coupling means;

said phase change material fluid at said second temperature in said coupling means other fluid path operable to exchange heat with said refrigerant in said one fluid path to reduce the temperature of said first refrigerant in said circuit ahead of said refrigerant-cooled apparatus to a third temperature less than said first temperature to expand the operating range of the refrigerant circuit of said refrigerant-cooled apparatus by operation with a refrigerant at a temperature less than said first temperature.

2. A supplemental cooling system as claimed in claim 1, wherein said first refrigerant circuit has means for compressing a refrigerant vapor from a first and low pressure to a second and higher pressure;

means for condensing at least a portion of said refrigerant vapor at said second pressure to a liquid, which condensing means is coupled to said compressing means;

said coupling means operable to connect said condensing means to said refrigerant-cooled apparatus to communicate said first refrigerant to said apparatus, which apparatus in said first refrigerant circuit is coupled downstream to said compressing means to recycle said refrigerant in said first circuit.

3. A supplemental cooling system as claimed in claim 2, wherein said one assembly has a low-temperature condensing application and said coupling means is an auxiliary condenser coupled between said compressing means and said condensing means in parallel with said first refrigerant circuit.

4. A supplemental cooling system as claimed in claim 2 wherein said one assembly has a liquid sub-cooling application and said coupling means is a liquid refrigerant sub-cooler having said one of said first and second fluid paths coupled in series in said first refrigerant circuit between said condensing means and said liquid sub-cooling application.

5. A supplemental cooling system as claimed in claim 2 wherein said compressing means is at least one compressor operable to receive a vapor at a first and lower pressue for compression to a second and higher pressure.

6. A supplemental cooling system as claimed in claim 2 wherein said compressing means has a plurality of compressors arranged in a parallel circuit to receive a vapor at a first and lower pressure for compression to a second and higher pressure.

7. A supplemental cooling system as claimed in claim 2 wherein said condensing means is an air cooled condenser.

8. A supplemental cooling system as claimed in claim 2 wherein said condensing means is an evaporative condenser.

9. A supplemental cooling system as claimed in claim 2 further comprising a liquid receiver coupled in parallel between said condensing means and said apparatus.

10. A supplemental cooling system as claimed in claim 1 wherein said means for providing a refrigerant is said second refrigerant circuit, said second circuit having a second refrigerant, said means for freezing is a cooling coil in said housing, which coil is coupled to said second refrigerant circuit to receive said second refrigerant to cool and freeze said at least a portion of said phase change material in said housing.

11. A supplemental cooling system as claimed in claim 10 wherein said second refrigerant circuit has means for compressing said second refrigerant and means for condensing said compressed second refrigerant from said compressing means.

12. A supplemental cooling system as claimed in claim 11 wherein said second circuit compressing means is a compressor.

13. A supplemental cooling system as claimed in claim 11 wherein said second circuit compressing means is a plurality of compressors arranged in parallel downstream from said coil to receive said second refrigerant from said coil for recirculating in said second circuit.

14. A supplemental cooling system as claimed in claim 11 wherein said one assembly first refrigerant circuit has means for compressing, said cooling system further comprising means for diverting, which diverting means is coupled between said condensing means and said one-assembly, first refrigerant-circuit, first compression means, said diverting means is actuable to connect said second refrigerant circuit and said first compression means to operate as said second circuit compression means.

15. A supplemental cooling system as claimed in claim 1 further comprising a control valve in said connecting means and operable to provide fluid communication of said phase change material to said housing input port in a reference mode;

a heat exchange device;

a second circulating pump connected between said connecting means and said heat exchange device;

a signal and sensing device operable to sense a physical parameter and provide an output control signal, said sensing device coupled to said second pump and operable to actuate said second pump;

said connecting means coupling said heat exchange device and said control valve downstream of said second pump, which pump is actuable by said signal and sensing device to communicate said cooler temperature phase-change fluid to said heat exchange device for reduction of air passing therethrough, said control valve operable to route said fluid to said pump for communication to said heat exchange device and to couple and return said fluid from said heat exchange device to said housing input port.

16. A supplemental cooling system as claimed in claim 15 wherein said heat exchange device is an air cooling apparatus.

17. A cooling system operable to reduce the temperature of a working coolant fluid of a cooling apparatus below a normal operating temperature, which working-coolant fluid is communicable to at least one coolant-cooled apparatus, said system comprising:

means for compressing having an inlet port and a discharge port, said compressing means operable to receive a first working fluid at a first vapor pressure and compress said first working fluid at said first vapor pressure to a second and higher vapor pressure at said discharge port;

means for condensing said first working fluid having a condenser entry port and a condenser exit port, which condensing means may be one of an air-cooled condenser and an evaporative condenser;

means for connecting, said compressing means discharge port and said condensing means coupled by said connecting means to communicate said first working fluid at said second vapor pressure to said condensing means;

means for thermal storage having an exit port, an entry port and a second working fluid therein, said second fluid being a phase-change fluid at a first and reference temperature, which second fluid at a thermal storage condition is at a second temperature lower than said reference temperature;

a first fluid circuit in said thermal storage means coupled to said means for condensing exit port by said connecting means and selectively operable to circulate said first working fluid from said condensing means to cool and freeze at least a portion of said second working fluid from said reference first temperature to said second and lower temperature;

an auxiliary condenser having a first internal-fluid circuit with an inlet port and an output port, and a second internal-fluid circuit with an inlet port and an output port, one of said first and second internal-fluid circuits coupled between said means for condensing and said means for compressing in one of a parallel and series arrangement, the other of said first and second internal-fluid circuits coupled by said connecting means to said thermal storage means entry port and said other internal-fluid output port, and said thermal storage exit port and said other internal-fluid inlet port, and operable to circulate said second working fluid at said second temperature through said auxiliary condenser to reduce the temperature of said first working fluid in said one internal-fluid circuit;

said connecting means coupling said auxiliary condenser and said condensing means to said coolant-cooled apparatus, a liquid receiver connected in parallel with said conducting means upstream of said coolant-cooled operator and operable to receive first working fluid from said condensing means at a normal working temperature and from said auxiliary condenser at a third and reduced temperature less than said normal working temperature, which reduced temperature working fluid is operable to expand the operating range of said coolant-cooled operator beyond a rated capacity with an extant cooling apparatus.

18. A cooling system as claimed in claim 17 wherein said second working fluid is one of water and, a water and glycol mixture.

19. A cooling system as claimed in claim 17, further comprising a low-temperature condensing service apparatus said one of said evaporative and air-cooled condenser outlet ports is coupled to said low-temperature, condensing service apparatus by said connecting means to couple said first fluid circuit and said condensing means to communicate said first working fluid at a temperature below said second temperature for heat transfer and temperature reduction of said second working fluid to said second temperature in said thermal storage means;

a second fluid circuit having means for circulating, said second circuit coupled by said connecting means between said thermal storage means exit port and entry port to circulate said second working fluid at a temperature below said first temperature, a third fluid circuit with a third operating fluid and at least one of a cooling and refrigeration apparatus, said second fluid circuit couplable to said third circuit by said connecting means to reduce the temperature of said third fluid in said third circuit to expand its operating range; said third cooling circuit is coupled to a low-temperature, condensing-service apparatus having a second auxiliary condenser and one of an air-cooled condenser and an evaporative condenser, which one condenser is coupled by said connecting means in a parallel arrangement with said second auxiliary condenser having a first internal fluid circuit, an input port and an output port for communication of said second working fluid from said thermal storage means to said second auxiliary condenser for heat exchange with said third working fluid to reduce its temperature to said apparatus.

20. A cooling system as claimed in claim 19, further comprising a liquid receiver coupled in parallel with said low-temperature condensing-service apparatus to said means for connecting.

21. A cooling system as claimed in claim 17 wherein said third cooling circuit has a liquid refrigerant subcooler apparatus, said third circuit comprising at least one means for compressing a working fluid.

22. A cooling system couplable to at least one refrigerant-cooled apparatus to reduce the refrigerant temperature for expansion of the apparatus operating range and reduction of power consumption at an equivalent apparatus cooling capacity, said cooling system comprising:

means for compressing a refrigerant, said compressing means having an input port and a discharge port, and operable to receive a refrigerant vapor at a first and low pressure for compression to a second and higher pressure;

means for connecting;

first means for condensing a refrigerant having an entry passage and an exit passage, said entry passage coupled to said compressing means discharge port by said connecting means for communication of said compressed refrigerant at a higher pressure to said condensing means for refrigerant condensation and communication to said apparatus at a working temperature;

means for thermal storage having a housing, a phase change material at an ambient temperature and means for receiving said refrigerant in said housing, said receiving means coupled between said condensing means exit passage and said compressing means input port by said connecting means to receive said refrigerant to freeze at least a portion of phase change material in said housing and reduce said phase-change material temperature at a second temperature less than said ambient temperature;

means for pumping said phase-change material;

said refrigerant-cooled apparatus having a refrigerant circuit;

means for coupling having a first fluid circuit and a second fluid circuit, one of said first and second fluid circuits coupled to said refrigerant circuit by said connecting means and operable to circulate said refrigerant between said coupling means and said refrigerant circuit upstream of said refrigerant apparatus, the other of said first and second fluid circuits coupled to said thermal storage means by said connecting means and operable to circulate said phase-change material at said second temperature in said second fluid circuit;

said pumping means coupled between said apparatus refrigerant circuit coupling means and said thermal-storage means housing to pump said phase change material at said second temperature to said coupling means for heat exchange and to reduce below said working temperature the temperature of said refrigerant in said refrigeration circuit for communication to said apparatus to expand its operating range.

23. A cooling system as claimed in claim 22, wherein said coupling means is an auxiliary condenser.

24. A cooling system as claimed in claim 22 further comprising a second refrigerant-cooled-apparatus having a refrigerant circuit and a second coupling means, said second-apparatus coupling means coupled to said pump and housing in parallel with said one refrigerant-cooled apparatus coupling means.

25. A cooling system as claimed in claim 22 further comprising a low-temperature condensing apparatus, said refrigerant-cooled-apparatus condensing means is an evaporative condenser coupled to said low-temperature-condensing apparatus and said compressing means by said connecting means, said evaporative condenser operable to condense said refrigerant and discharge a high-pressure liquid refrigerant to said low-temperature condensing apparatus for cooling and return to said means for compressing.

26. A cooling system as claimed in claim 24, wherein said second refrigerant-cooled-apparatus coupling means is a liquid refrigerant sub-cooler.

27. A cooling system as claimed in claim 26 further comprising a sub-cooled-liquid apparatus, said second refrigerant-cooled apparatus having an evaporative condenser, said sub-cooler is coupled between said second refrigerant-cooled-apparatus evaporative condenser and said sub-cooled-liquid apparatus, for cooling and return of said refrigerant to said second means for compressing.

28. A cooling system as claimed in claim 24 further comprising an air-cooling apparatus having a coolant circuit with a thermal control valve and a secondary circulating pump therein, said air-cooling apparatus coupled to said pump to receive said fluid for one of diversion of said phase-change fluid to said second pump, said air-cooling apparatus and return to said housing in a first mode, and to direct said fluid to said housing in a second mode.

* * * * *